US012104462B1

(12) United States Patent
El Mallawany et al.

(10) Patent No.: US 12,104,462 B1
(45) Date of Patent: Oct. 1, 2024

(54) INTERVENTIONLESS STIMULATION AND PRODUCTION SYSTEMS, MULTI-ZONE INTERVENTIONLESS STIMULATION AND PRODUCTION ASSEMBLIES, AND METHODS TO PERFORM INTERVENTIONLESS STIMULATION AND PRODUCTION OPERATIONS

(71) Applicant: Halliburton Energy Services, Inc., Houston, TX (US)

(72) Inventors: Ibrahim El Mallawany, Al-Khobar (SA); Ahmed Mohamed, Al Khobar (SA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/226,749

(22) Filed: Jul. 26, 2023

(51) Int. Cl.
*E21B 34/14* (2006.01)
*E21B 34/06* (2006.01)
(Continued)

(52) U.S. Cl.
CPC ..... *E21B 34/142* (2020.05); *E21B 34/063* (2013.01); *E21B 43/26* (2013.01);
(Continued)

(58) Field of Classification Search
CPC .... E21B 2200/06; E21B 34/142; E21B 43/26; E21B 43/14; E21B 34/14; E21B 34/103;
(Continued)

(56) References Cited

U.S. PATENT DOCUMENTS 7,703,510 B2 4/2010 Xu
8,499,841 B2 8/2013 Tinker
(Continued)

FOREIGN PATENT DOCUMENTS

CA 2900940 A1 * 9/2014 ..... E21B 23/04
WO WO-2015112905 A1 * 7/2015 ..... E21B 23/006
(Continued)

OTHER PUBLICATIONS

International Search Report and Written Opinion mailed Feb. 20, 2024 for PCT/US2023/067581.
(Continued)

*Primary Examiner* — Zakiya W Bates
(74) *Attorney, Agent, or Firm* — Barnes & Thornburg LLP

(57) ABSTRACT

An interventionless stimulation and production system includes a housing and a stimulation sleeve. The stimulation sleeve includes a first diverter seat, and a second diverter seat initially having a smaller diameter, where the first diverter seat is configured to permit a first diverter to pass through the first diverter seat and prevent a second diverter having a larger diameter from passing through the first diverter seat, the second diverter seat is initially configured to prevent the first diverter from passing through the second diverter seat, and landing the first diverter onto the second diverter seat shifts the stimulation sleeve from a first position to a second position to initiate a stimulation operation. The stimulation also includes a production sleeve that is initially in a closed position, where the production sleeve is configured to shift to an open position after the second diverter lands on the first diverter seat.

20 Claims, 10 Drawing Sheets

(51) Int. Cl.
*E21B 43/08* (2006.01)
*E21B 43/26* (2006.01)

(52) U.S. Cl.
CPC ..... *E21B 43/08* (2013.01); *E21B 2200/06* (2020.05); *E21B 2200/08* (2020.05)

(58) Field of Classification Search
CPC ..... E21B 34/10; E21B 43/261; E21B 34/063; E21B 34/06; E21B 34/102; E21B 33/124; E21B 43/25; E21B 33/12; E21B 34/12; E21B 43/12; E21B 43/16
See application file for complete search history.

(56) References Cited

U.S. PATENT DOCUMENTS

| | | | | |
|---|---|---|---|---|
| 9,394,777 | B2 | 7/2016 | Cheng et al. | |
| 9,574,421 | B1 | 2/2017 | Saraya | |
| 9,951,596 | B2 | 4/2018 | Lynk | |
| 10,669,830 | B2 | 6/2020 | Facca et al. | |
| 10,994,493 | B2 | 5/2021 | Linde et al. | |
| 2003/0221837 | A1 | 12/2003 | Giroux et al. | |
| 2008/0210429 | A1* | 9/2008 | McMillin ..... | E21B 43/14 166/313 |
| 2009/0266659 | A1 | 10/2009 | Lembcke et al. | |
| 2011/0114334 | A1 | 5/2011 | Palacios | |
| 2011/0278017 | A1 | 11/2011 | Themig et al. | |
| 2013/0037273 | A1 | 2/2013 | Themig et al. | |
| 2014/0034319 | A1 | 2/2014 | Surjaatmadja et al. | |
| 2014/0158357 | A1 | 6/2014 | Lyashkov et al. | |
| 2014/0246209 | A1 | 9/2014 | Themig et al. | |
| 2015/0260012 | A1 | 9/2015 | Themig | |
| 2016/0160603 | A1 | 6/2016 | Sevadjian et al. | |
| 2017/0022784 | A1 | 1/2017 | Johnson | |
| 2018/0347330 | A1 | 12/2018 | Facca et al. | |
| 2019/0100980 | A1 | 4/2019 | Fuxa et al. | |
| 2020/0024936 | A1 | 1/2020 | Chang et al. | |
| 2020/0080404 | A1* | 3/2020 | Frosell ..... | E21B 43/26 |
| 2021/0079759 | A1 | 3/2021 | Benson | |
| 2021/0348474 | A1 | 11/2021 | Johnson | |

FOREIGN PATENT DOCUMENTS

| | | | |
|---|---|---|---|
| WO | 2016112612 | A1 | 7/2016 |
| WO | 2020018755 | A1 | 1/2020 |

OTHER PUBLICATIONS

International Search Report and Written Opinion in PCT/US2023/030871, Mailed Apr. 19, 2024.

* cited by examiner

INTERVENTIONLESS STIMULATION AND PRODUCTION SYSTEMS, MULTI-ZONE INTERVENTIONLESS STIMULATION AND PRODUCTION ASSEMBLIES, AND METHODS TO PERFORM INTERVENTIONLESS STIMULATION AND PRODUCTION OPERATIONS

BACKGROUND

The present disclosure relates generally to interventionless stimulation and production systems, multi-zone interventionless stimulation and production assemblies, and methods to perform interventionless stimulation and production operations.

Hydrocarbon wells are sometimes isolated to form multiple zones where stimulation, production, and other well operations are performed within each zone of the multiple zones. Tools and assemblies are run downhole to perform stimulation, production, and other types of operations.

BRIEF DESCRIPTION OF THE DRAWINGS

Illustrative embodiments of the present disclosure are described in detail below with reference to the attached drawing figures, which are incorporated by reference herein, and wherein.

Figure 1:
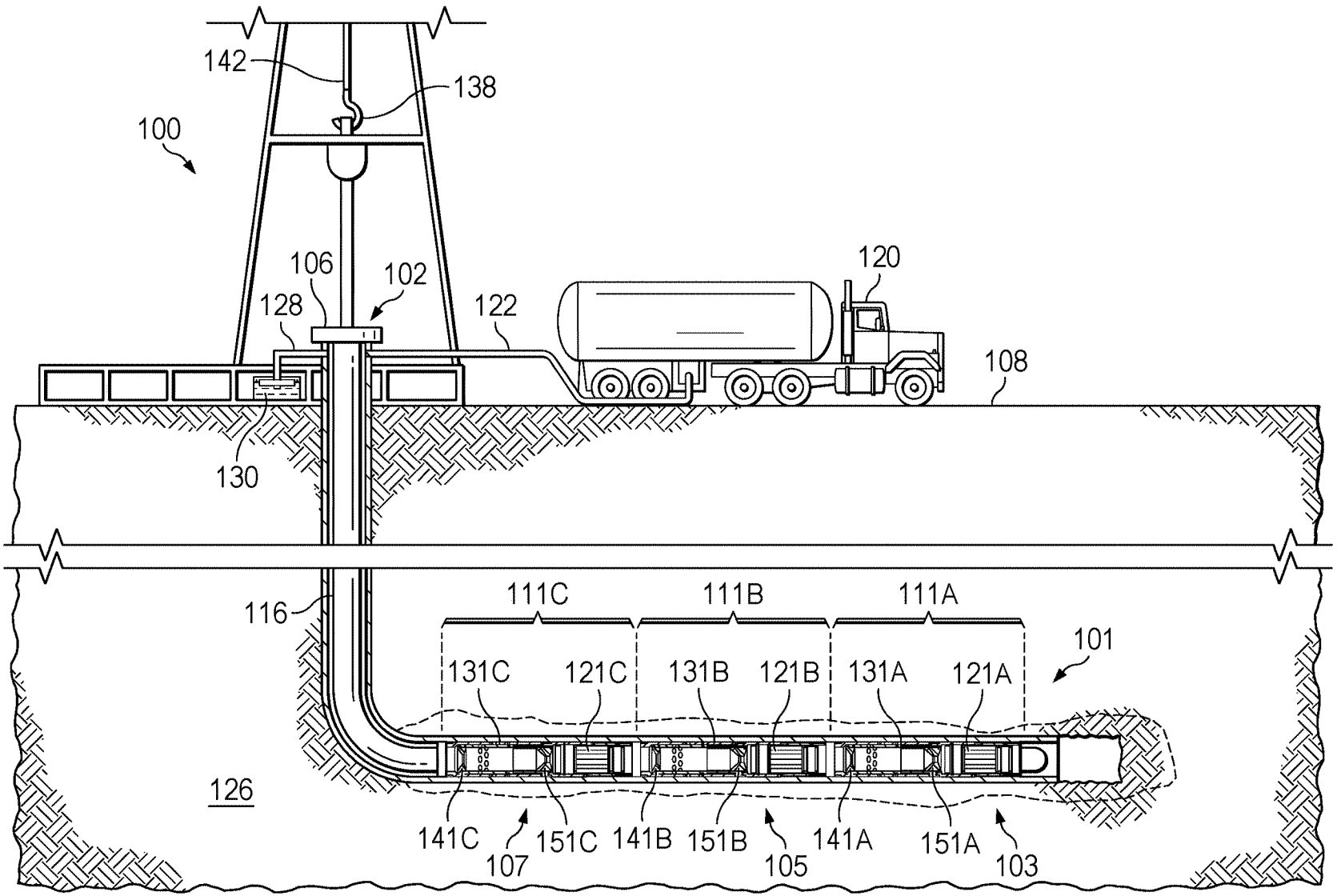
FIG. 1 is a schematic, side view of a well environment where an interventionless stimulation and production assembly is deployed.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to interventionless stimulation and production systems, multi-zone interventionless stimulation and production assemblies, and methods to perform interventionless stimulation and production operations. An interventionless stimulation and production system has a stimulation sleeve that is shiftable through a housing of the interventionless stimulation and production system. As referred to herein, a stimulation sleeve is any sleeve that is shiftable from one position to another position to facilitate a stimulation operation, such as a fracturing operation. The stimulation sleeve is initially in a closed position (first position) when the interventionless stimulation and production system is run downhole, and is shiftable to an open position (second position) to initiate a stimulation operation.

The stimulation sleeve has a first diverter seat positioned along one side of the stimulation sleeve, and a second diverter seat that is positioned along another side of the stimulation sleeve. As referred to herein, a diverter seat is any seat or element that is configured to receive a diverter. Examples of diverters and diverter seats include, but are not limited to, ball seats and balls, dart seats and darts, etc. The diameter of the second diverter seat is initially smaller than the diameter of the first diverter seat, such that the first diverter is configured to permit a first diverter to pass through the first diverter seat, and the second diverter seat is configured to initially prevent the first diverter from passing through the second diverter seat. In some embodiments, the second diverter seat is positioned downstream from the first diverter seat to permit the first diverter to flow downhole, through the first diverter seat, and eventually land on the second diverter seat. The landing of the first diverter onto the second diverter seat shifts the stimulation sleeve from the closed position to the open position to initiate a stimulation operation. More particularly, the landing of the first diverter onto the second diverter seat applies a force to shift the simulation sleeve from the closed position to the open position. In some embodiments, additional pressure is applied to the first diverter after the first diverter lands on the second diverter seat to shift the stimulation sleeve from the closed position to the open position. In some embodiments, where the stimulation sleeve is initially held in the closed position by a shear member, landing the first diverter onto the second diverter seat and/or applying additional pressure onto the first diverter shears the shear member, thereby permitting the stimulation sleeve to shift from the closed position to the open position. The shifting of the stimulation sleeve also permits the diameter of the second diverter seat to increase, thereby permitting the first diverter to flow through the second diverter seat (and into an adjacent zone downhole of the current zone where the current zone is not the most bottom zone). In some embodiments, where the housing and the stimulation sleeve both have ports used during stimulation operations, the ports of the housing and stimulation sleeve are not initially aligned while the stimulation sleeve is in the closed position to prevent premature stimulation operations. In one or more of such embodiments, the ports of the stimulation sleeve and housing are aligned after the stimulation sleeve is shifted to the open position to initiate the stimulation operation.

The interventionless stimulation and production system also has a production sleeve that is initially in a closed position. As referred to herein, a production sleeve is any sleeve or element that is shiftable from a closed position to an open position to facilitate a production operation. In some embodiments, the production sleeve is positioned downhole of the stimulation sleeve. In some embodiments, the production sleeve is position uphole of the stimulation sleeve. The production sleeve is subsequently shifted from the closed position to the open position after a second diverter lands on the first diverter seat. In some embodiments, after the stimulation operation is complete and the production operation is ready to commence, the second diverter is pumped downhole, where landing the second diverter onto the first diverter seat also shifts the stimulation sleeve from the open position to a third position (closed position).

In some embodiments, the production sleeve is initially held in the closed position by a shear to prevent the production sleeve from shifting prematurely. In some embodiments, the production sleeve includes one or more ports that are initially sealed by an object, such as a dissolvable object to prevent fluid flow through the production sleeve before commencement of the production operation. In one or more of such embodiments, the dissolvable object is initially prevented from coming into contact with a dissolving fluid while the production sleeve is in the closed position to prevent fluid flow through the production sleeve before commencement of the production operation. In one or more of such embodiments, the dissolvable object comes into contact with the dissolving fluid after the production sleeve is shifted from the closed position to the open position. In some embodiments, the interventionless stimulation and production system has an atmospheric chamber that is initially adjacent to the dissolvable object to prevent the dissolvable object from coming into contact with the dissolving fluid. In one or more of such embodiments, shifting the production sleeve from the closed position towards the open position introduces the dissolving fluid into the atmospheric chamber. In some embodiments, a non-dissolvable fluid initially prevents the dissolvable object from coming into contact with the dissolving fluid. In one or more of such embodiments, shifting the production sleeve from the closed position towards the open position at least partially replaces the non-dissolvable fluid with the dissolvable fluid.

In some embodiments, the interventionless stimulation and production system includes a second stimulation sleeve that is positioned uphole of the stimulation sleeve (e.g., in an adjacent zone uphole of the zone the stimulation sleeve is positioned within). In some embodiments, the zones of the first sleeve and second sleeve are separated by isolation packers. In one or more of such embodiments, the second stimulation sleeve has a third diverter seat positioned along one side of the second stimulation sleeve, and a fourth diverter seat that is positioned along another side of the second stimulation sleeve. The diameter of the fourth diverter seat is initially smaller than the diameter of the third diverter seat, such that the second diverter (which is also used to shift the stimulation sleeve from the open position to the closed position, and shift the production sleeve from the closed position to the open position) is configured to pass through the third diverter seat and land on the fourth diverter seat. The landing of the second diverter onto the fourth diverter seat shifts the second stimulation sleeve from the closed position to the open position to initiate a second stimulation operation. More particularly, the landing of the second diverter onto the fourth diverter seat applies a force to shift the second simulation sleeve from the closed position to the open position. In some embodiments, additional pressure is applied to the second diverter after the second diverter lands on the fourth diverter seat to shift the second stimulation sleeve from the closed position to the open position. In some embodiments, where the second stimulation sleeve is initially held in the closed position by a shear member, landing the second diverter onto the fourth diverter seat and/or applying additional pressure onto the second diverter shears the shear member, thereby permitting the second stimulation sleeve to shift from the closed position to the open position. The shifting of the second stimulation sleeve also permits the diameter of the fourth diverter seat to increase, thereby permitting the second diverter to flow through the fourth diverter seat. In some embodiments, where the housing and the second stimulation sleeve both have ports used during second stimulation operations, the ports of the housing and second stimulation sleeve are not initially aligned while the second stimulation sleeve is in the closed position to prevent premature stimulation operations. In one or more of such embodiments, the ports of the second stimulation sleeve and housing are aligned after the second stimulation sleeve is shifted to the open position to initiate the second stimulation operation. In some embodiments the stimulation ports have erodible nozzles. In one or more of such embodiments, the erodible nozzles permit flow to direct ball to the first stimulation below and allow pressure build up to shift it closed. Once the first stimulation sleeve below is closed, all flow will be forced through the erodible nozzles. In one or more of such embodiments, the flow will eventually erode the nozzles increasing the ID to permit sufficient stimulation through them. In one or more of such embodiments, the interventionless stimulation and production system also has a second production sleeve that is initially in a closed position. The second production sleeve is subsequently shifted from the closed position to the open position after a third diverter lands on the first diverter seat. In some embodiments, after the second stimulation operation is complete and the second production operation is ready to commence, the third diverter is pumped downhole, where landing the third diverter onto the third diverter seat also shifts the second stimulation sleeve from the open position to a closed position.

In some embodiments, multiple interventionless stimulation and production systems, each having a stimulation sleeve and a production sleeve, are deployed in different zones and together form an interventionless stimulation and production assembly. In one or more of such embodiments, the stimulation sleeves and production sleeves of the interventionless stimulation and production assembly are configured to sequentially shift as described herein to initiate and complete interventionless stimulation and production operations across multiple zones. Additional descriptions of an interventionless stimulation and production assembly are provided herein and illustrated in at least FIG. 1. In some embodiments, the interventionless stimulation and production system also includes a screen that extends from the housing. In some embodiments, the interventionless stimulation and production system also includes a flow control device to regulate flow of production fluids after the production sleeve shifts from the closed position to the open position. In some embodiments, the diverter seats of the interventionless stimulation and production system are configured to permit diverters to flow back (uphole) through the diverter seats. In some embodiments, the diverters are formed from dissolvable materials, and dissolve after completion of stimulation operation, during production operation, or after a predetermined period of time. In some embodiments, only pressure (without a diverter) is applied to the bottommost seat of an interventionless stimulation and production system or a multi-zone interventionless stimulation and production assembly to perform the operations described herein to establish fluid and pressure communication from the tubing to the annulus. Additional descriptions of the foregoing interventionless stimulation and production systems, multi-zone interventionless stimulation and production assemblies, and methods to perform interventionless stimulation and production operations are described in the paragraphs below and are illustrated in FIGS. 1-6.

Turning now to the figures, FIG. 1 is a schematic, side view of a well environment 100 in which an interventionless stimulation and production assembly 101 is deployed in a well 102. As shown in FIG. 1, a wellbore 106 of well 102 extends from surface 108 of well 102 to or through formation 126.

A hook 138, cable 142, traveling block (not shown), and hoist (not shown) are provided to lower a conveyance 116 that is coupled to interventionless stimulation and production assembly 101 down wellbore 106 of well 102 or to lift conveyance 116 up from wellbore 106 of well 102. In one or more embodiments, conveyance 116 may be a drill string, drill pipe, wireline, slickline, coiled tubing, production tubing, downhole tractor or another type of conveyance operable to be deployed in wellbore 106. At a wellhead of well 102, an inlet conduit 122 is coupled to a fluid source (not shown) to provide fluids, such as stimulation fluids, downhole to interventionless stimulation and production assembly 101. In the embodiment of FIG. 1, conveyance 116 has one or more internal cavities that provide fluid flow paths from surface 108 to interventionless stimulation and production assembly 101. Conveyance 116 also has one or more return paths to permit fluids to flow from interventionless stimulation and production assembly 101 uphole through a diverter or an outlet conduit 128 and into a container 130 at the wellhead.

In the embodiment of FIG. 1, interventionless stimulation and production assembly 101 has three interventionless stimulation and production systems 103, 105, and 107, that extend through three zones 111A, 111B, and 111C, respectively. More particularly, first interventionless stimulation and production system 103 has a first production sleeve 121A and a first stimulation sleeve 131A, second interventionless stimulation and production system 105 has a second production sleeve 121B and a second stimulation sleeve 131B, and third interventionless stimulation and production system 107 has a third production sleeve 121C and a third stimulation sleeve 131C, where each sleeve is in a closed position as shown in FIG. 1, and each sleeve is shiftable from their respective closed positions to open positions during different well operations. Further, each of first stimulation sleeve 131A, second stimulation sleeve 131B, and third stimulation sleeve 131C has a first diverter seat 141A, 141B, and 141C, and a second diverter seat 151A, 151B, and 151C, respectively. In the embodiment of FIG. 1, second diverter seat 151A initially has the smallest diameter. In some embodiments, the dimensions of each diverter is greater than the dimensions of the adjacent downhole diverter, and is less than the adjacent uphole diverter. In some embodiments, adjacent first and second diverter seats of adjacent sleeves have similar or identical diameters. For example, the IDs of first diverter seat 141A and second diverter seat 151B are similar or identical to each other. Similarly, the IDS of second diverter seat 141B and first diverter seat 151C are similar or identical to each other. After interventionless stimulation and production assembly 101 is deployed downhole, a diverter (e.g., a ball, not shown) is pumped downhole via conveyance 116, where the diverter lands on second diverter seat 151A. Force applied by the diverter onto second diverter seat 151A shifts first stimulation sleeve 131A from the initial closed position to an open position (not shown), and aligns the ports of the first stimulation sleeve with the ports of a housing of first interventionless stimulation and production system 103 to initiate a first stimulation operation in zone 111A. After stimulation of zone 103 is complete, a second diverter is subsequently pumped downhole, where the second diverter initially lands on second diverter seat 151B. Force applied to second diverter seat 151B and/or additional pressure applied to the second diverter shifts the second stimulation sleeve 131B from the closed position to an open position to initiate a second stimulation operation in zone 111B. The shifting of the second stimulation sleeve 131B also causes the dimensions of second diverter seat 151B to increase (e.g., by shifting second diverter seat 151B to a location that permits second diverter seat 151B to radially expand), thereby permitting the second diverter to flow through second diverter seat 151B, where the second diverter eventually lands on first diverter seat 141A. Force applied to first diverter seat 151A and/or additional pressure applied to the second diverter also shifts the first stimulation sleeve 131A from the open position to another closed position. The force/pressure also shifts first production sleeve 121A from the closed position to an open position to prepare for initiation of a first production operation within zone 111A after completion of the stimulation (fracturing) operation.

A third diverter is subsequently pumped downhole, where the third diverter initially lands on second diverter seat 151C. Force applied to second diverter seat 151C and/or additional pressure applied to the third diverter shifts third stimulation sleeve 131C from the closed position to an open position to initiate a third stimulation operation in zone 111C. The shifting of the third stimulation sleeve 131C also causes the dimensions of second diverter seat 151C to increase (e.g., by shifting third diverter seat 151C to a location that permits third diverter seat 151C to radially expand), thereby permitting the third diverter to flow through second diverter seat 151C, where the third diverter eventually lands on first diverter seat 141B. Force applied to first diverter seat 141B and/or additional pressure applied to the third diverter also shifts the second stimulation sleeve 131B from the open position to another closed position. The force/pressure also shifts second production sleeve 121B from the closed position to an open position to prepare for initiation of a second production operation within zone 111B after completion of the stimulation (fracturing) operation.

Although FIG. 1 illustrates an interventionless stimulation and production assembly 101 having three interventionless stimulation and production systems 103, 105, and 107, that extend through three zones 111A, 111B, and 111C disposed in zones, in some embodiments, interventionless stimulation and production assembly 101 has a different number of interventionless stimulation and production systems (not shown) disposed in a different number of zones (not shown). In some embodiments, multiple interventionless stimulation and production systems are deployed in a single zone.

Further, although FIG. 1 illustrates each of interventionless stimulation and production systems 103, 105, and 107 having one stimulation sleeve and one production sleeve, in some embodiments, interventionless stimulation and production systems have multiple pairs of stimulation and production sleeves that are disposed across multiple zones or in a single zone. Further, although FIG. 1 illustrates production sleeves 121A, 121B, and 121C being positioned downhole from corresponding stimulation sleeves 131A, 131B, and 131C, respectively, in some embodiments, production sleeves 121A, 121B, and 121C are positioned uphole of corresponding stimulation sleeves 131A, 131B, and 131C, respectively Additional descriptions of interventionless stimulation and production assembly 101, interventionless stimulation and production systems 103, 105, and 107, similar assembles and systems, and operations performed by the assemblies and systems are provided herein and are illustrated in at least FIGS. 2-6.

Figure 2:
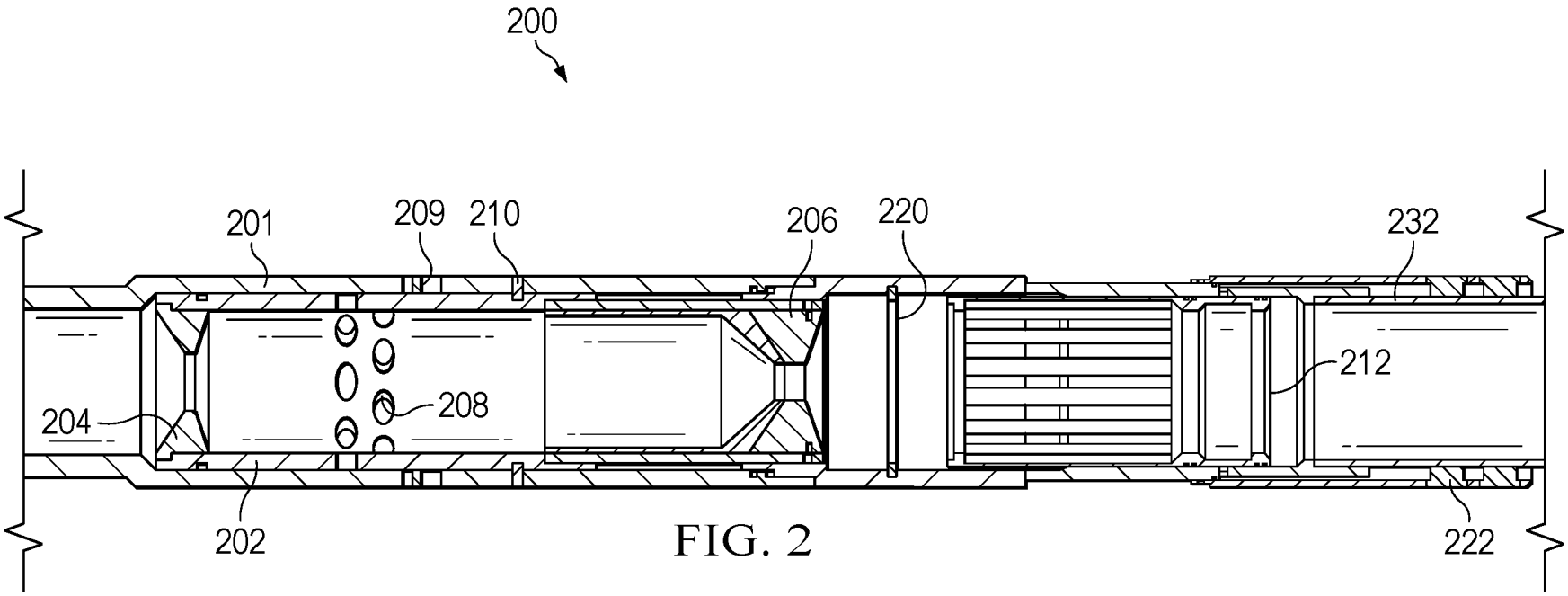
FIG. 2 is a cross-sectional view of an interventionless stimulation and production system similar to an interventionless stimulation and production system of the interventionless stimulation and production assembly of FIG. 1.

FIG. 2 is a cross-sectional view of an interventionless stimulation and production system 200 similar to an interventionless stimulation and production systems 103, 105, or 107 of interventionless stimulation and production assembly 100 of FIG. 1. In the embodiment of FIG. 2, interventionless stimulation and production system 200 has a stimulation sleeve 202 that is shiftable with respect to a housing 201. Stimulation sleeve 202 has a first diverter seat 204 and a second diverter seat 206 that has an internal diameter that is initially smaller than the internal diameter of first diverter seat 204. Stimulation sleeve 202 also has ports 208 that are not initially aligned with ports 209 of housing 201 while stimulation sleeve 202 is in a closed position. A shear member 210 is also initially coupled to housing 201 and stimulation sleeve 202 to prevent stimulation sleeve 202 from prematurely shifting with respect to housing 201. Interventionless stimulation and production system 200 also includes a production sleeve 212 that is also initially in a closed position as shown in FIG. 2. A second shear member 220 is positioned between stimulation sleeve 202 and housing 201 and configured to prevent stimulation sleeve 202 from engaging production sleeve 212 while second shear member 220 is intact, thereby preventing the production sleeve 212 from prematurely shifting before commencement of a production operation. In the embodiment of FIG. 2, interventionless stimulation and production system 200 also includes an inflow control device 222 and a screen 232 that are configured to regulate fluid flow during one or more operations of interventionless stimulation and production system 200. Although inflow control device 222 is shown as a passive device, in some embodiments, inflow control device 222 is an active or passive autonomous inflow control device configured to choke water production and allow oil production based on some fluid property. Additional descriptions of interventionless stimulation and production system 200 and components of interventionless stimulation and production system 200 are provided herein and illustrated in at least FIGS. 3A-6.

Although FIG. 2 illustrates production sleeve 212 being downhole of stimulation sleeve 202, in some embodiments, production sleeve 212 is positioned uphole of stimulation sleeve 202. Further, although FIG. 2 illustrates interventionless stimulation and production system 200 having one stimulation sleeve 202 and one production sleeve 212, in some embodiments, interventionless stimulation and production system 200 has multiple sets of production sleeves and stimulation sleeves (not shown). In one or more of such embodiments, each set of production sleeve and stimulation sleeve is positioned in a separate zone of a well. In one or more of such embodiments, multiple sets of production and stimulation sleeves are positioned within a single zone of a wellbore.

Figure 3A:
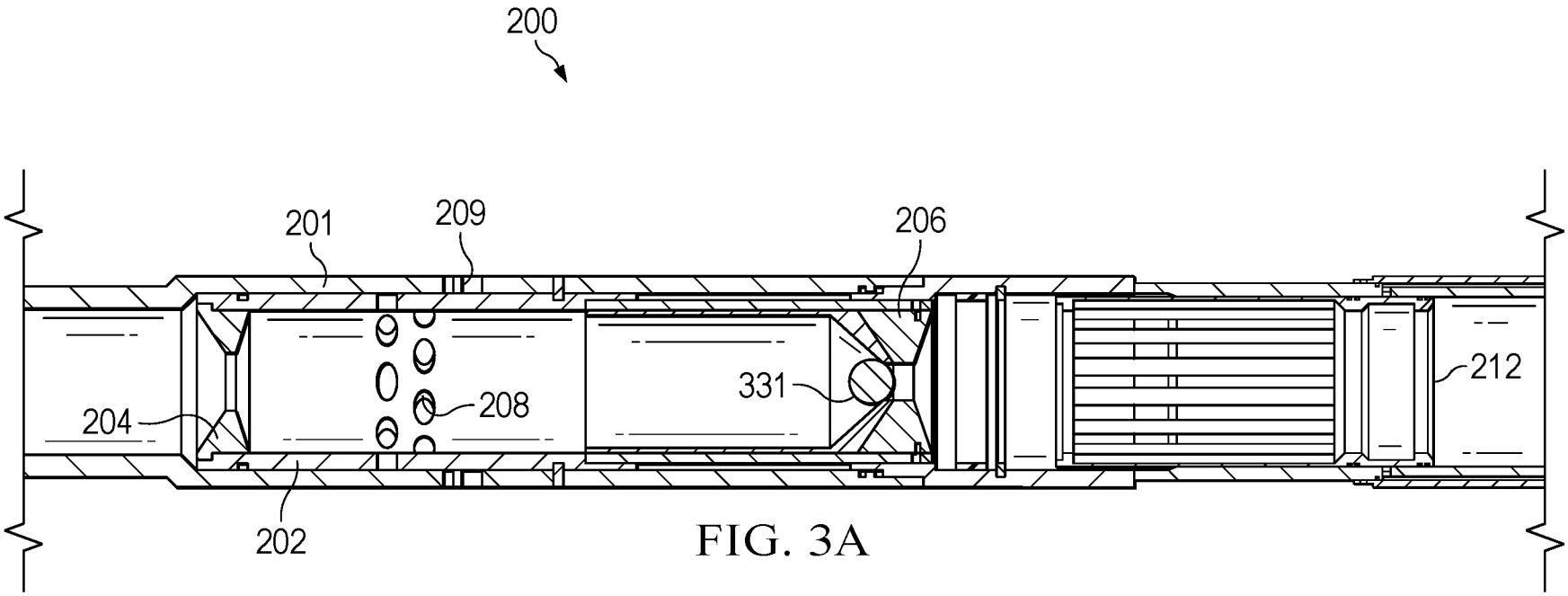
FIG. 3A is a cross-sectional view of the interventionless stimulation and production system of FIG. 2 while the stimulation sleeve is in a closed position.

FIG. 3A is a cross-sectional view of interventionless stimulation and production system 200 of FIG. 2 while stimulation sleeve 202 is in a closed position. In the embodiment of FIG. 3A, ports 208 of stimulation sleeve 202 are not aligned with ports 209 of housing 201 to prevent fluids from flowing through ports 208 and 209 prior to commencement of a stimulation operation. A ball 331 is pumped into interventionless stimulation and production system 200. In the embodiment of FIG. 3A, ball 331 flows through first diverter seat 204 and lands on second diverter seat 206. In some embodiments, force applied by ball 331 and/or additional pressure applied to ball 331 after ball 331 lands on second diverter seat 206 shifts simulation sleeve 202 from the closed position illustrated in FIG. 3A to an open position to commence a stimulation operation.

Figure 3B:
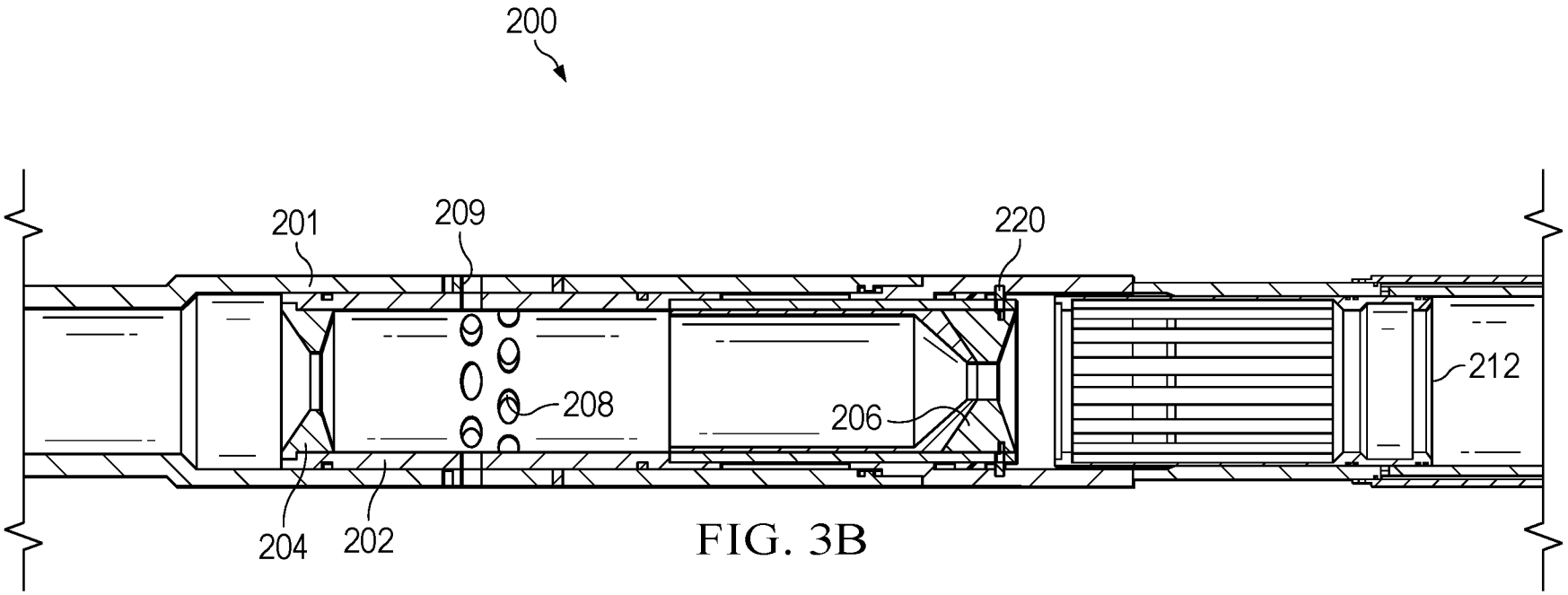
FIG. 3B is a cross-sectional view of the interventionless stimulation and production system of FIG. 3A after the stimulation sleeve has shifted from the closed position to an open position.

In that regard, FIG. 3B is a cross-sectional view of interventionless stimulation and production system 200 of FIG. 3A after stimulation sleeve 202 has shifted from the closed position as illustrated in FIG. 3A to an open position as illustrated in FIG. 3B. In the embodiment of FIG. 3B, ports 208 of stimulation sleeve 202 are aligned with ports 209 of housing 201 to permit fluids (such as fracture fluids and other types of fluids to flow) through ports 208 and 209 during a stimulation operation. Further, the inner diameter of second diverter seat 206, while second diverter seat 206 is in the position illustrated in FIG. 3B, is greater than the inner diameter of second diverter seat 206 while second diverter seat 206 is in the position illustrated in FIG. 3A, thereby allowing ball 331 (not shown) to pass through second diverter seat 206. In the embodiment of FIG. 3B, shear member 220 prevents stimulation sleeve 202 from shifting further downhole, thereby maintaining stimulation sleeve 202 in the open position during the stimulation operation. In some implementations, stimulation sleeve 202 also includes a shock absorber 252 such as a spring, a dampener, a dampening fluid or another apparatus/mechanism/fluid positioned between stimulation sleeve 202 and shear member 220 and configured to reduce the impact on shear member 220 to avoid shear member 220 being prematurely sheared (such as due to premature failure upon impact). After completion of stimulation operation, another diverter, such as a ball similar to ball 331, is pumped into interventionless stimulation and production system 200 to close stimulation sleeve 202.

Figure 3C:
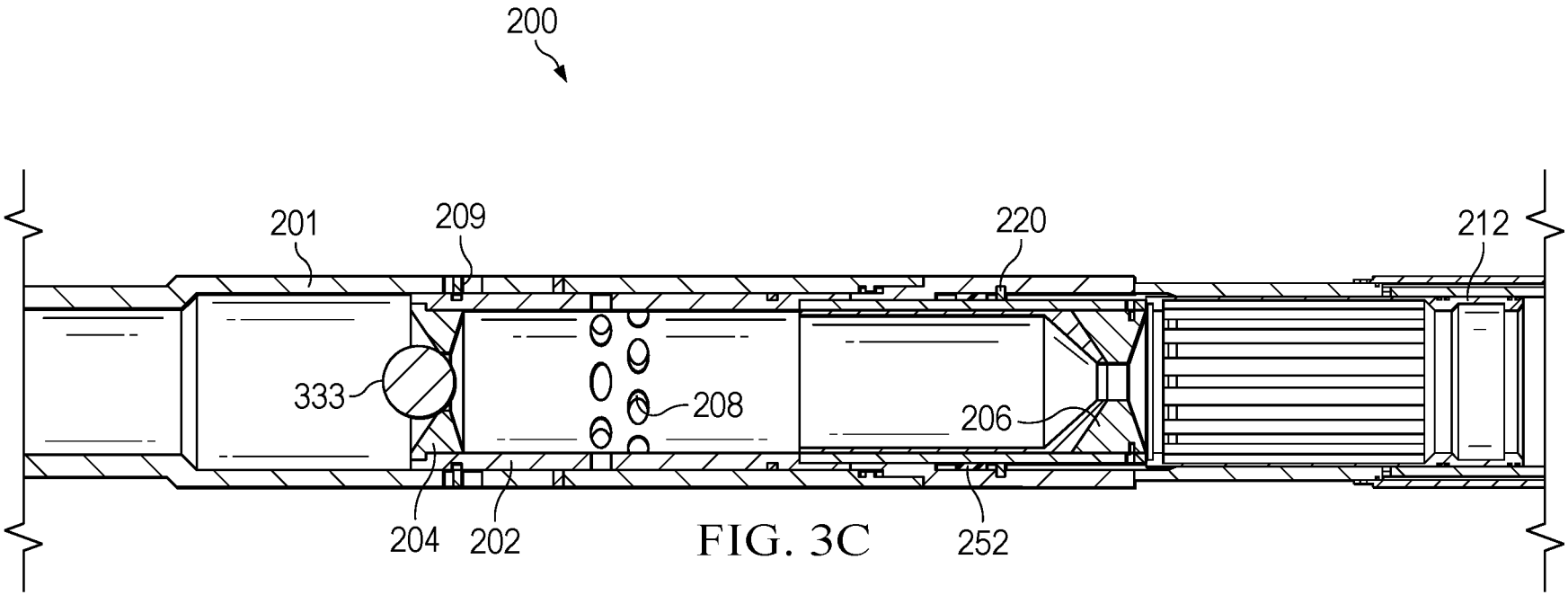
FIG. 3C is a cross-sectional view of the interventionless stimulation and production system of FIG. 3B after the stimulation sleeve has shifted from the open position to a second closed position.

In that regard, FIG. 3C is a cross-sectional view of interventionless stimulation and production system 200 of FIG. 3B after stimulation sleeve 202 has shifted from the open position illustrated in FIG. 3B to a second closed position. In the embodiment of FIG. 3C, a second ball 333 has landed on first diverter seat 204. Force applied by second ball 333 onto first diverter seat 204 and/or additional pressure applied to second ball 333 breaks shear 220, thereby permitting stimulation sleeve 202 to shift from the open position illustrated in FIG. 3B to the closed position illustrated in FIG. 3C. In some embodiments, stimulation sleeve 202 is further configured to engage production sleeve 212 to shift production sleeve 212 from a closed position to an open position to prepare for commencement of a production operation after the stimulation operation is complete. In some embodiments, a diverter, such as ball 331 of FIG. 3A, is configured to land on a diverter seat (not shown) of production sleeve 212 to shift production sleeve 212 from the closed position to an open position to prepare for commencement of the production operation.

Figure 4:
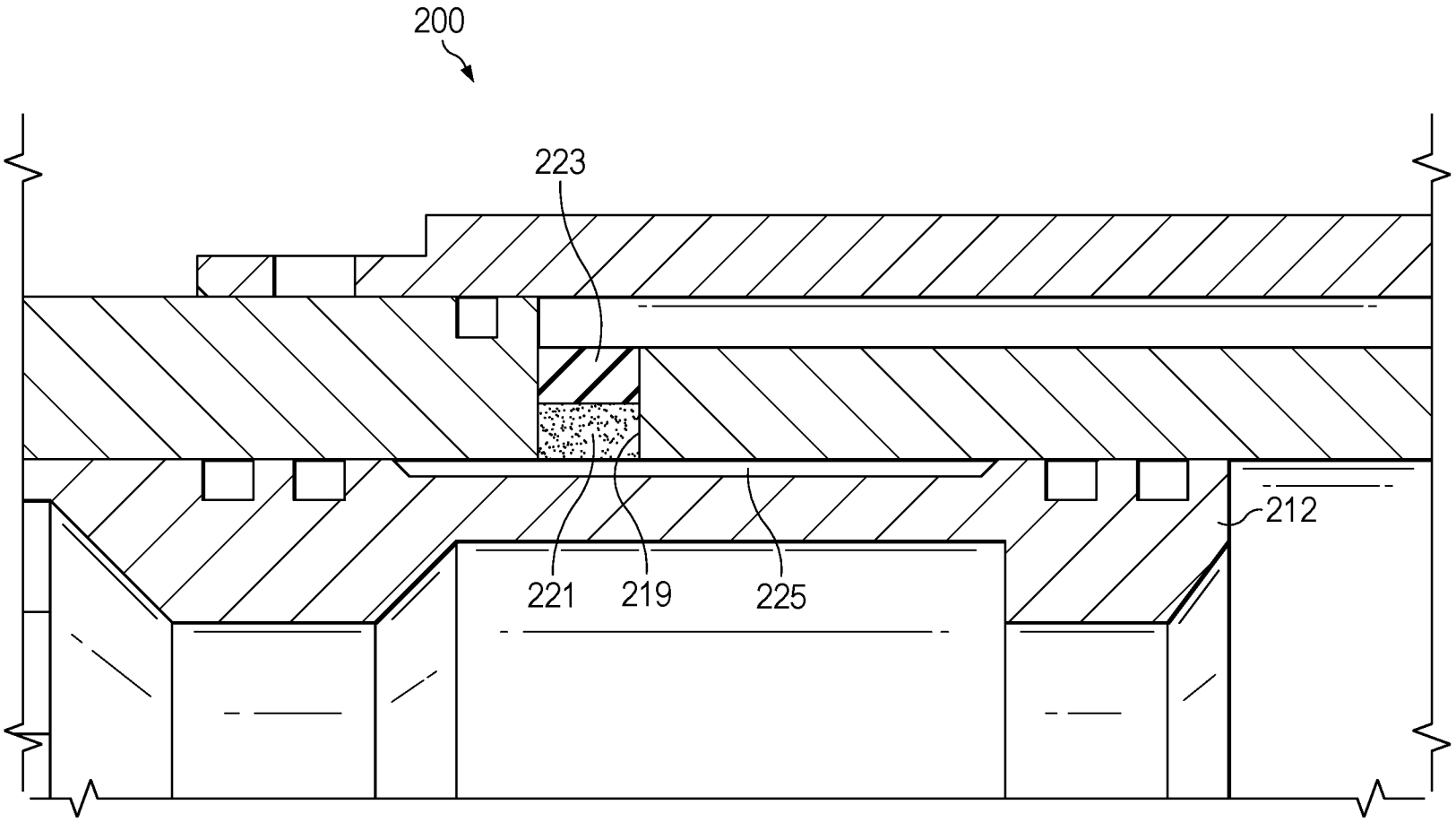
FIG. 4 is a cross-sectional view of the interventionless stimulation and production system having a production port that is initially plugged with a dissolvable material.

FIG. 4 is a cross-sectional view of interventionless stimulation and production system 200 of FIG. 2 having a production port 219 that is initially plugged with a dissolvable material 221. In the embodiment of FIG. 4, a non-dissolvable barrier 223 (e.g., a coating or a rubber cap) is initially coupled to one surface of dissolvable material 221 to prevent dissolvable material 221 from coming into contact with any dissolving fluid. Further, an atmospheric chamber or a non-dissolving fluid (e.g., oil or air) 225 is initially adjacent to dissolvable material 221. Atmospheric chamber or non-dissolving fluid 225 also prevents dissolvable material 221 from coming into contact with any dissolving fluid when production sleeve 212 is in the closed position. However, after production sleeve 212 shifts to an open position, a dissolving fluid comes into contact with dissolvable material 221 after flowing into atmospheric chamber 225 or mixing with non-dissolving fluid 225 to open production port 219. In some embodiments, the dissolving fluid is introduced or comes into contact with dissolvable material 221 after a certain amount of time to ensure completion of the stimulation operations. In some embodiments, the dissolving fluid comes into contact with dissolvable material 221 before production sleeve 212 shifts to the open position to account for time taken to dissolve dissolvable material 221 and open production port 219. In some embodiments production port 219 is fitted with an erodible nozzle (not shown).

Figure 5A:
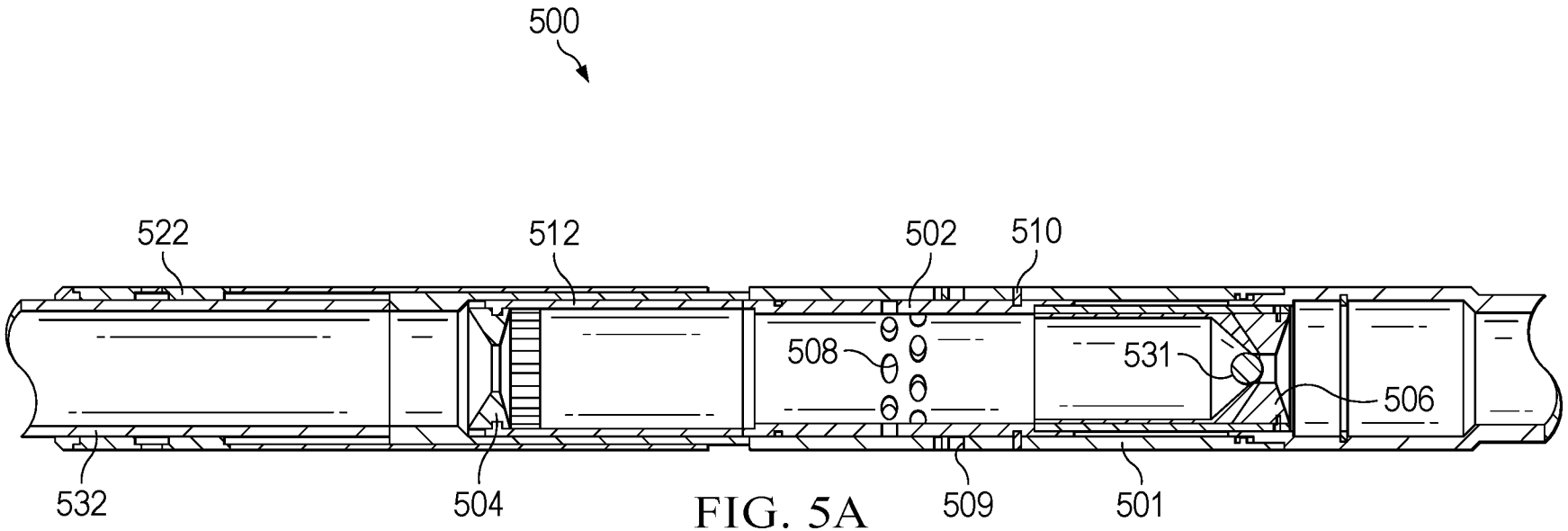
FIG. 5A is a cross-sectional view of another interventionless stimulation and production system while the stimulation sleeve is in a closed position.

FIG. 5A is a cross-sectional view of another interventionless stimulation and production system 500 while stimulation sleeve 502 is in a closed position. In the embodiment of FIG. 5A, interventionless stimulation and production system 500 has a stimulation sleeve 502 that is shiftable with respect to a housing 501, and a production sleeve 512 that is positioned uphole of stimulation sleeve 502. Production sleeve 512 has a first diverter seat 504, and stimulation sleeve 502 has a second diverter seat 506 that has an internal diameter that is initially smaller than the internal diameter of first diverter seat 504. Stimulation sleeve 502 also has ports 508 that are not initially aligned with ports 509 of housing 501 while stimulation sleeve 502 is in a closed position. A shear 510 is also initially coupled to housing 501 and stimulation sleeve 502 to prevent stimulation sleeve 502 from prematurely shifting with respect to housing 501. In the embodiment of FIG. 5, interventionless stimulation and production system 500 also includes an inflow control device 522 and a screen 532 that are configured to regulate fluid flow during one or more operations of interventionless stimulation and production system 500.

A ball 531 is pumped into interventionless stimulation and production system 500. In the embodiment of FIG. 5A, ball 531 flows through first diverter seat 504 and lands on second diverter seat 506. In some embodiments, force applied by ball 531 and/or additional pressure applied to ball 531 after ball 531 lands on second diverter seat 506 shifts simulation sleeve 502 from the closed position illustrated in FIG. 5A to an open position to commence a stimulation operation.

Figure 5B:
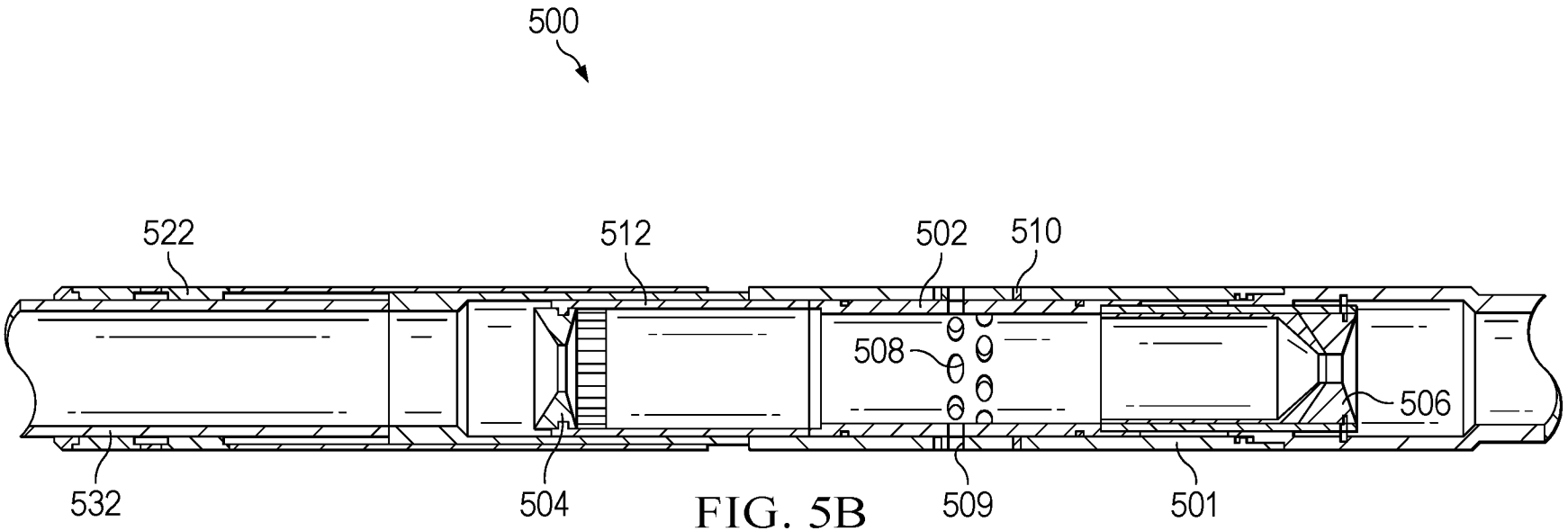
FIG. 5B is a cross-sectional view of the interventionless stimulation and production system of FIG. 5A after the stimulation sleeve has shifted from the closed position to an open position.

In that regard, FIG. 5B is a cross-sectional view of interventionless stimulation and production system 500 of FIG. 5A after stimulation sleeve 502 has shifted from the closed position illustrated in FIG. 5A to an open position. In the embodiment of FIG. 5B, ports 508 of stimulation sleeve 502 are aligned with ports 509 of housing 501 to permit fluids (such as fracture fluids and other types of fluids) to flow through ports 508 and 509 during a stimulation operation. Further, the inner diameter of second diverter seat 506, while second diverter seat 506 is in the position illustrated in FIG. 5B, is greater than the inner diameter of second diverter seat 506 while second diverter seat 506 is in the position illustrated in FIG. 5A, thereby allowing ball 531 (not shown) to pass through second diverter seat 506. After completion of the stimulation operation, another diverter such as a ball similar to ball 531 is pumped into interventionless stimulation and production system 500 to close stimulation sleeve 502.

Figure 5C:
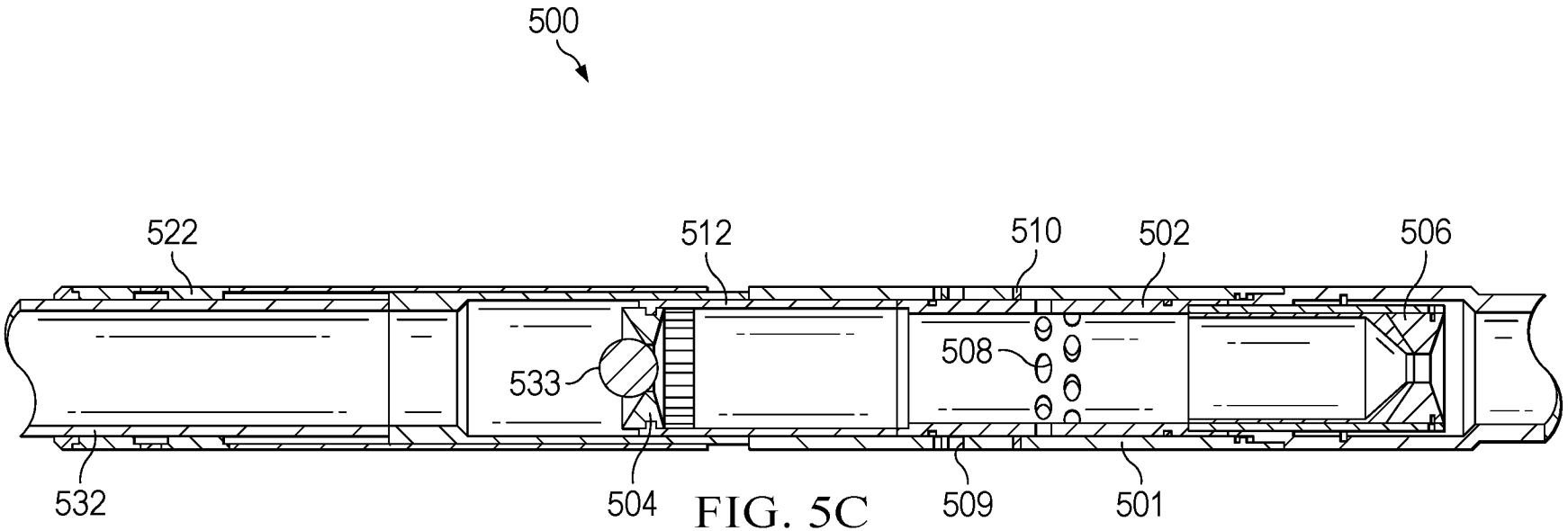
FIG. 5C is a cross-sectional view of the interventionless stimulation and production system of FIG. 5B after the stimulation sleeve has shifted from the open position to a second closed position.

In that regard, FIG. 5C is a cross-sectional view of interventionless stimulation and production system 500 of FIG. 5B after the stimulation sleeve has shifted from the open position illustrated in FIG. 5B to a second closed position. In the embodiment of FIG. 5C, a second ball 533 has landed on first diverter seat 504. Force applied by second ball 533 onto first diverter seat 504 and/or additional pressure applied to first ball 533 shears a shear (not shown) and shifts production sleeve 512 from the closed position illustrated in FIG. 5B to an open position to commence a production operation. Further, stimulation sleeve 502 is also shifted from the open position illustrated in FIG. 5B to the closed position illustrated in FIG. 5C.

Figure 6:
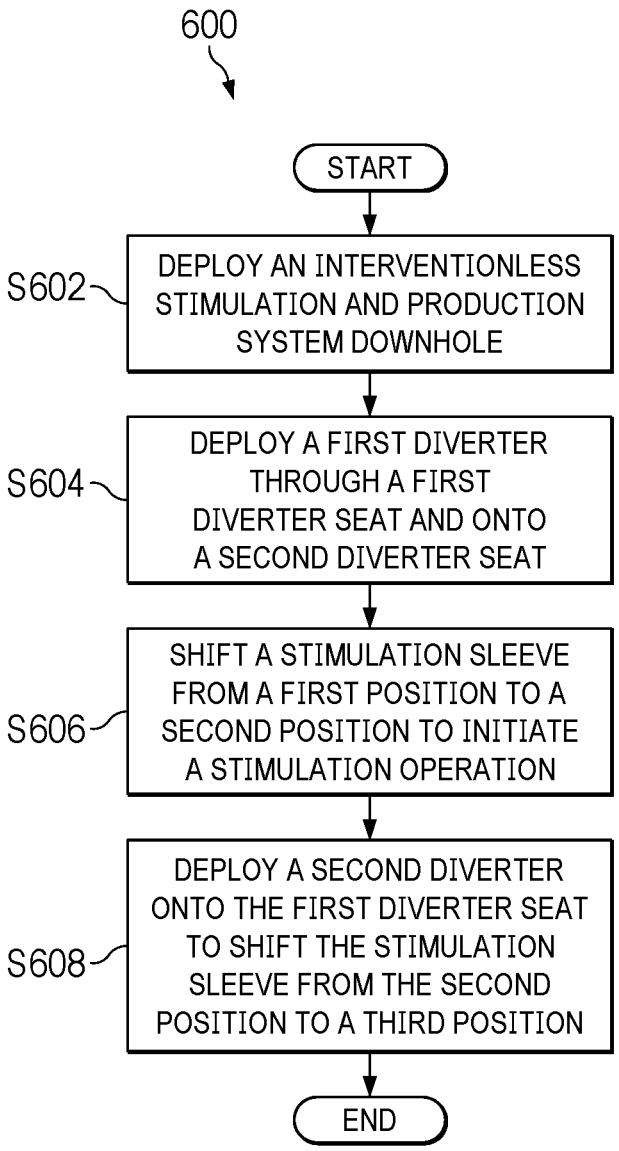
FIG. 6 is a flow chart of a process to perform an interventionless stimulation and production operation.

FIG. 6 is a flow chart of a process 600 to perform an interventionless stimulation and production operation. Although the operations in process 600 are shown in a particular sequence, certain operations may be performed in different sequences or at the same time where feasible.

At block S602, an interventionless stimulation and production system is deployed downhole. FIG. 1, for example, illustrates deployment of interventionless stimulation and production systems 103, 105, and 107 into well 102.

At block S604, a first diverter is pumped through a first diverter seat onto a second diverter seat. FIG. 3A, for example, illustrates deploying ball 331 through first diverter seat 204 and onto second diverter seat 206. At block S606, the stimulation sleeve is shifted from a first position of the stimulation sleeve to a second position of the stimulation sleeve. FIGS. 3A-3B for example, illustrate shifting stimulation sleeve 202 from the closed position illustrated in FIG. 3A to an open position illustrated in FIG. 3B to initiate a stimulation operation. Similarly, FIGS. 5A-5B illustrate shifting simulation sleeve 502 from the closed position illustrated in FIG. 5A to an open position illustrated in FIG. 5B to initiate a stimulation operation. In some embodiments, where a shear member initially prevents the stimulation sleeve to shift from the closed position, a threshold amount of force is applied onto the first diverter to shear the shear member. Further, the diverter seat is shifted from the first diverter seat position to a second diverter seat position to permit the first diverter to flow through the second diverter seat. In that regard, FIGS. 3A-3B illustrate shifting second diverter seat 206 from the first diverter seat position illustrated in FIG. 3A to the second diverter seat position to increase the internal diameter of second diverter seat 206 to permit ball 331 to pass through second diverter seat 206.

At block S608, a second diverter is deployed onto the first diverter seat to shift the stimulation sleeve from the second position to a third position, and to shift the production sleeve from the closed position to an open position to initiate a production operation. In that regard, FIGS. 3B-3C illustrate shifting stimulation sleeve 202 from the open position illustrated in FIG. 3B to another closed position illustrated in FIG. 3C. FIGS. 3B-3C also illustrate shifting production sleeve 212 from the closed position illustrated in FIG. 3B to an open position illustrated in FIG. 3C to prepare for initiation of a production operation. Similarly, FIGS. 5B-5C illustrate shifting stimulation sleeve 502 from the open position illustrated in FIG. 5B to another closed position illustrated in FIG. 5C. FIGS. 5B-5C also illustrate shifting production sleeve 512 from the closed position illustrated in FIG. 5B to an open position illustrated in FIG. 5C. In some embodiments, after the production sleeve is shifted from the closed position towards the open position, a dissolving fluid is introduced to come into contact with a dissolvable object that initially seals a production port to prevent fluid flow through the production port while the production sleeve is in the closed position. In some embodiments, process 600 is repeated to perform interventionless stimulation and production operations in multiple zones or at multiple sets of stimulation and production sleeves. In some embodiments, only pressure (without a diverter) is applied to the bottom-most seat of an interventionless stimulation and production system or a multi-zone interventionless stimulation and production assembly to perform the operations described herein to establish fluid and pressure communication from the tubing to the annulus.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, an interventionless stimulation and production system, comprising: a housing; a stimulation sleeve shiftable through the housing, the stimulation sleeve comprising: a first diverter seat; and a second diverter seat initially having a smaller diameter than the first diverter seat, wherein the first diverter seat is configured to permit a first diverter to pass through the first diverter seat, and prevent a second diverter having a larger diameter than the first diverter from passing through the first diverter seat, wherein the second diverter seat is initially configured to prevent the first diverter from passing through the second diverter seat, and wherein landing the first diverter onto the second diverter seat shifts the stimulation sleeve from a first position of the stimulation sleeve to a second position of the stimulation sleeve to initiate a stimulation operation; and a production sleeve that is initially in a closed position, wherein the production sleeve is configured to shift to an open position after the second diverter lands on the first diverter seat.

Clause 2, the interventionless stimulation and production system of clause 1, further comprising a production port that is initially sealed with a dissolvable object.

Clause 3, the interventionless stimulation and production system of clause 2, wherein the dissolvable object is initially prevented from coming into contact with a dissolving fluid while the production sleeve is in the closed position.

Clause 4, the interventionless stimulation and production system of clause 3, wherein the dissolvable object comes into contact with the dissolving fluid after the production sleeve is shifted from the closed position towards an open position.

Clause 5, the interventionless stimulation and production system of any of clauses 2-4, wherein the production port is initially sealed by the stimulation sleeve.

Clause 6, the interventionless stimulation and production system of any of clauses 2-5, wherein the production port is initially sealed by an erodible nozzle.

Clause 7, the interventionless stimulation and production system of any of clauses 2-6, further comprising an atmospheric chamber that is initially adjacent to the dissolvable object, wherein shifting the production sleeve from the closed position towards the open position introduces the dissolving fluid into the atmospheric chamber.

Clause 8, the interventionless stimulation and production system of any of clauses 2-7, further comprising a non-dissolving fluid that is initially adjacent to the dissolvable object to prevent the dissolvable object from coming into contact with the dissolving fluid, wherein shifting the production sleeve from the closed position towards the open position at least partially replaces the non-dissolving fluid with the dissolving fluid.

Clause 9, the interventionless stimulation and production system of any of clauses 1-8, wherein the first diverter seat and the second diverter seat are configured to permit the first diverter and the second diverter to flow back through the first diverter seat and the second diverter seat, respectively.

Clause 10, the interventionless stimulation and production system of any of clauses 1-9, wherein the second diverter seat is configured to radially expand after the stimulation sleeve shifts to the second position.

Clause 11, the interventionless stimulation and production system of any of clauses 1-10, further comprising a shear member positioned between the stimulation sleeve and the housing, wherein the shear member is configured to prevent the stimulation sleeve from prematurely engaging the production sleeve.

Clause 12, the interventionless stimulation and production system of clause of clause 11, further comprising a shock absorber positioned between the stimulation sleeve and the shear member and configured to reduce the impact on the shear member.

Clause 13, the interventionless stimulation and production system of clauses 11 or 12, further comprising: a screen that extends from the housing; and a flow control device configured to regulate flow of production fluids after the production sleeve shifts from the closed position to the open position.

Clause 14, the interventionless stimulation and production system of any of clauses 1-13, further comprising: a second stimulation sleeve shiftable through the housing, the second stimulation sleeve comprising: a third diverter seat; and a fourth diverter seat initially having a smaller diameter than the third diverter seat, wherein the third diverter seat is configured to permit the second diverter to pass through the third diverter seat, and prevent a third diverter having a larger diameter than the second diverter from passing through the third diverter seat, wherein the fourth diverter seat is initially configured to prevent the second diverter from passing through the fourth diverter seat, and wherein landing the second diverter onto the fourth diverter seat shifts the second stimulation sleeve from a first position of the second stimulation sleeve to a second position of the second stimulation sleeve to initiate a second stimulation operation; and a second production sleeve that is initially in a closed position, wherein the second production sleeve is configured to shift to an open position after the third diverter lands on the third diverter seat.

Clause 15, a multi-zone interventionless stimulation and production assembly, comprising: a first housing; a first stimulation sleeve shiftable through the first housing, the first stimulation sleeve comprising: a first diverter seat; and a second diverter seat initially having a smaller diameter than the first diverter seat, wherein the first diverter seat is configured to permit a first diverter to pass through the first diverter seat, and prevent a second diverter having a larger diameter than the first diverter from passing through the first diverter seat, wherein the second diverter seat is initially configured to prevent the first diverter from passing through the second diverter seat, and wherein landing the first diverter onto the second diverter seat shifts the first stimulation sleeve from a first position of the first stimulation sleeve to a second position of the first stimulation sleeve to initiate a first stimulation operation; a first production sleeve that is initially in a first closed position, wherein the first production sleeve is configured to shift to a first open position after the second diverter lands on the first diverter seat; a second housing; a second stimulation sleeve shiftable through the second housing, the second stimulation sleeve comprising: a third diverter seat; and a fourth diverter seat initially having a smaller diameter than the third diverter seat, wherein the third diverter seat is configured to permit the second diverter to pass through the third diverter seat, and prevent a third diverter having a larger diameter than the second diverter from passing through the third diverter seat, wherein the fourth diverter seat is initially configured to prevent the second diverter from passing through the fourth diverter seat, and wherein landing the second diverter onto the fourth diverter seat shifts the second stimulation sleeve from a first position of the second stimulation sleeve to a second position of the second stimulation sleeve to initiate a second stimulation operation; and a second production sleeve that is initially in a second closed position, wherein the second production sleeve is configured to shift to a second open position after the third diverter lands on the third diverter seat.

Clause 16, the multi-zone interventionless stimulation and production assembly of clause 15, further comprising: a first production port that is initially sealed with a first dissolvable object while the first production sleeve is in the closed position; and a second production port that is initially sealed with a second dissolvable object while the second production sleeve is in the second closed position.

Clause 17, a method to perform interventionless stimulation and production operations, comprising: deploying an interventionless stimulation and production system downhole, the interventionless stimulation and production comprising: a housing; a stimulation sleeve shiftable through the housing, the stimulation sleeve comprising: a first diverter seat; and a second diverter seat initially having a smaller diameter than the first diverter seat; and a production sleeve that is initially in a closed position; deploying a first diverter through the first diverter seat and onto the second diverter seat; shifting the stimulation sleeve from a first position of the stimulation sleeve to a second position of the stimulation sleeve to initiate a stimulation operation; and deploying a second diverter onto the first diverter seat to shift the stimulation sleeve from the second position to a third position, and to shift the production sleeve from the closed position to an open position to initiate a production operation.

Clause 18, the method of clause 17, further comprising: after shifting the production sleeve from the closed position towards the open position, introducing a dissolving fluid to come into contact with a dissolvable object that initially seals a production port to prevent fluid flow through the production port while the production sleeve is in the closed position.

Clause 19, the method of clauses 17 or 18, further comprising: applying a threshold amount of pressure onto the first diverter to shear a shear member that initially prevents the stimulation sleeve from moving through the housing; after applying the threshold amount of pressure, shifting the second diverter seat from a first diverter seat position to a second diverter seat position to permit the first diverter to flow through the second diverter seat.

Clause 20, the method of any of clauses 17-19, further comprising: deploying a second interventionless stimulation and production system downhole, the second interventionless stimulation and production comprising: a second stimulation sleeve comprising: a third diverter seat; and a fourth diverter seat initially having a smaller diameter than the third diverter seat; and a second production sleeve that is initially in a second closed position; deploying the second diverter through the third diverter seat and onto the fourth diverter seat; shifting the second stimulation sleeve from a first position of the second stimulation sleeve to a second position of the second stimulation sleeve to initiate a second stimulation operation; deploying a third diverter onto the third diverter seat to shift the second stimulation sleeve from the second position to a third position, and to shift the production sleeve from the second closed position to a second open position to initiate a second production operation.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. An interventionless stimulation and production system, comprising:

a housing;

a stimulation sleeve shiftable through the housing, the stimulation sleeve comprising:

a first diverter seat; and a second diverter seat initially having a smaller diameter than the first diverter seat, wherein the first diverter seat is configured to permit a first diverter to pass through the first diverter seat, and prevent a second diverter having a larger diameter than the first diverter from passing through the first diverter seat, wherein the second diverter seat is initially configured to prevent the first diverter from passing through the second diverter seat, and wherein landing the first diverter onto the second diverter seat shifts the stimulation sleeve from a first position of the stimulation sleeve to a second position of the stimulation sleeve to initiate a stimulation operation; and a production sleeve that is initially in a closed position, wherein the production sleeve is configured to shift to an open position after the second diverter lands on the first diverter seat.

2. The interventionless stimulation and production system of claim 1, further comprising a production port that is initially sealed with a dissolvable object.

3. The interventionless stimulation and production system of claim 2, wherein the dissolvable object is initially prevented from coming into contact with a dissolving fluid while the production sleeve is in the closed position.

4. The interventionless stimulation and production system of claim 3, wherein the dissolvable object comes into contact with the dissolving fluid after the production sleeve is shifted from the closed position towards an open position.

5. The interventionless stimulation and production system of claim 2, wherein the production port is initially sealed by the stimulation sleeve.

6. The interventionless stimulation and production system of claim 2, wherein the production port is initially sealed by an erodible nozzle.

7. The interventionless stimulation and production system of claim 2, further comprising an atmospheric chamber that is initially adjacent to the dissolvable object, wherein shifting the production sleeve from the closed position towards the open position introduces the dissolving fluid into the atmospheric chamber.

8. The interventionless stimulation and production system of claim 2, further comprising a non-dissolving fluid that is initially adjacent to the dissolvable object to prevent the dissolvable object from coming into contact with the dissolving fluid, wherein shifting the production sleeve from the closed position towards the open position at least partially replaces the non-dissolving fluid with the dissolving fluid.

9. The interventionless stimulation and production system of claim 1, wherein the first diverter seat and the second diverter seat are configured to permit the first diverter and the second diverter to flow back through the first diverter seat and the second diverter seat, respectively.

10. The interventionless stimulation and production system of claim 1, wherein the second diverter seat is configured to radially expand after the stimulation sleeve shifts to the second position.

11. The interventionless stimulation and production system of claim 1, further comprising a shear member positioned between the stimulation sleeve and the housing, wherein the shear member is configured to prevent the stimulation sleeve from prematurely engaging the production sleeve.

12. The interventionless stimulation and production system of claim of claim 11, further comprising a shock absorber positioned between the stimulation sleeve and the shear member and configured to reduce the impact on the shear member.

13. The interventionless stimulation and production system of claim 1, further comprising:

a screen that extends from the housing; and a flow control device configured to regulate flow of production fluids after the production sleeve shifts from the closed position to the open position.

14. The interventionless stimulation and production system of claim 1, further comprising:

a second stimulation sleeve shiftable through the housing, the second stimulation sleeve comprising:

a third diverter seat; and a fourth diverter seat initially having a smaller diameter than the third diverter seat, wherein the third diverter seat is configured to permit the second diverter to pass through the third diverter seat, and prevent a third diverter having a larger diameter than the second diverter from passing through the third diverter seat, wherein the fourth diverter seat is initially configured to prevent the second diverter from passing through the fourth diverter seat, and wherein landing the second diverter onto the fourth diverter seat shifts the second stimulation sleeve from a first position of the second stimulation sleeve to a second position of the second stimulation sleeve to initiate a second stimulation operation; and a second production sleeve that is initially in a closed position, wherein the second production sleeve is configured to shift to an open position after the third diverter lands on the third diverter seat.

15. A multi-zone interventionless stimulation and production assembly, comprising:

a first housing;

a first stimulation sleeve shiftable through the first housing, the first stimulation sleeve comprising:

a first diverter seat; and a second diverter seat initially having a smaller diameter than the first diverter seat, wherein the first diverter seat is configured to permit a first diverter to pass through the first diverter seat, and prevent a second diverter having a larger diameter than the first diverter from passing through the first diverter seat, wherein the second diverter seat is initially configured to prevent the first diverter from passing through the second diverter seat, and wherein landing the first diverter onto the second diverter seat shifts the first stimulation sleeve from a first position of the first stimulation sleeve to a second position of the first stimulation sleeve to initiate a first stimulation operation;

a first production sleeve that is initially in a first closed position, wherein the first production sleeve is configured to shift to a first open position after the second diverter lands on the first diverter seat;

a second housing;

a second stimulation sleeve shiftable through the second housing, the second stimulation sleeve comprising:

a third diverter seat; and a fourth diverter seat initially having a smaller diameter than the third diverter seat, wherein the third diverter seat is configured to permit the second diverter to pass through the third diverter seat, and prevent a third diverter having a larger diameter than the second diverter from passing through the third diverter seat, wherein the fourth diverter seat is initially configured to prevent the second diverter from passing through the fourth diverter seat, and wherein landing the second diverter onto the fourth diverter seat shifts the second stimulation sleeve from a first position of the second stimulation sleeve to a second position of the second stimulation sleeve to initiate a second stimulation operation; and a second production sleeve that is initially in a second closed position, wherein the second production sleeve is configured to shift to a second open position after the third diverter lands on the third diverter seat.

16. The multi-zone interventionless stimulation and production assembly of claim 15, further comprising:

a first production port that is initially sealed with a first dissolvable object while the first production sleeve is in the closed position; and a second production port that is initially sealed with a second dissolvable object while the second production sleeve is in the second closed position.

17. A method to perform interventionless stimulation and production operations, comprising:

deploying an interventionless stimulation and production system downhole, the interventionless stimulation and production comprising:

a housing;

a stimulation sleeve shiftable through the housing, the stimulation sleeve comprising:

a first diverter seat; and a second diverter seat initially having a smaller diameter than the first diverter seat; and a production sleeve that is initially in a closed position;

deploying a first diverter through the first diverter seat and onto the second diverter seat;

shifting the stimulation sleeve from a first position of the stimulation sleeve to a second position of the stimulation sleeve to initiate a stimulation operation; and deploying a second diverter onto the first diverter seat to shift the stimulation sleeve from the second position to a third position, and to shift the production sleeve from the closed position to an open position to initiate a production operation.

18. The method of claim 17, further comprising:

after shifting the production sleeve from the closed position towards the open position, introducing a dissolving fluid to come into contact with a dissolvable object that initially seals a production port to prevent fluid flow through the production port while the production sleeve is in the closed position.

19. The method of claim 17, further comprising:

applying a threshold amount of pressure onto the first diverter to shear a shear member that initially prevents the stimulation sleeve from moving through the housing;

after applying the threshold amount of pressure, shifting the second diverter seat from a first diverter seat position to a second diverter seat position to permit the first diverter to flow through the second diverter seat.

20. The method of claim 17, further comprising:

deploying a second interventionless stimulation and production system downhole, the second interventionless stimulation and production comprising:

a second stimulation sleeve comprising:

a third diverter seat; and a fourth diverter seat initially having a smaller diameter than the third diverter seat; and a second production sleeve that is initially in a second closed position;

deploying the second diverter through the third diverter seat and onto the fourth diverter seat;

shifting the second stimulation sleeve from a first position of the second stimulation sleeve to a second position of the second stimulation sleeve to initiate a second stimulation operation;

deploying a third diverter onto the third diverter seat to shift the second stimulation sleeve from the second position to a third position, and to shift the production sleeve from the second closed position to a second open position to initiate a second production operation.

* * * * *